US009364765B2

(12) United States Patent
Kane et al.

(10) Patent No.: US 9,364,765 B2
(45) Date of Patent: Jun. 14, 2016

(54) TOY ASSEMBLY WITH BLOWER AND COLOR CHANGING FEATURES

(71) Applicant: Mattel, Inc., El Segundo, CA (US)

(72) Inventors: Erika Kane, San Pedro, CA (US); Eric Lau, Yuen Long (HK); Melissa Ozuna, Redondo Beach, CA (US); Catherine Wong, Ap Lei Chau (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/321,263

(22) Filed: Jul. 1, 2014

(65) Prior Publication Data

US 2014/0315470 A1 Oct. 23, 2014

Related U.S. Application Data

(62) Division of application No. 13/212,326, filed on Aug. 18, 2011, now abandoned.

(60) Provisional application No. 61/374,816, filed on Aug. 18, 2010.

(51) Int. Cl.

| | |
|---|---|
| ***A63H 33/22*** | (2006.01) |
| ***A63H 33/30*** | (2006.01) |
| ***A63H 3/44*** | (2006.01) |
| ***A63H 37/00*** | (2006.01) |

(52) U.S. Cl.

CPC ..... *A63H 3/44* (2013.01); *A63H 33/22* (2013.01); *A63H 33/30* (2013.01); *A63H 33/3072* (2013.01); *A63H 37/00* (2013.01)

(58) Field of Classification Search

CPC ..... A63H 3/003; A63H 3/44; A63H 33/22; A63H 37/00; A63H 33/30; A63H 33/3072; A45D 20/00; A45D 20/12

See application file for complete search history.

(56) References Cited

U.S. PATENT DOCUMENTS

| | | | | |
|---|---|---|---|---|
| 1,491,809 | A | 4/1924 | Macchia | |
| 2,345,173 | A | 3/1944 | Baggott | |
| 3,382,607 | A | 5/1968 | Ryan et al. | |
| 3,731,421 | A | 5/1973 | Frattolillo et al. | |
| 4,176,273 | A | 11/1979 | Fujie et al. | |
| 4,257,188 | A | 3/1981 | Barker | |
| 4,297,564 | A * | 10/1981 | Bartolac | A45D 20/12 34/96 |
| 4,361,981 | A | 12/1982 | Reiling et al. | |
| 4,725,462 | A | 2/1988 | Kimura | |
| 4,818,215 | A | 4/1989 | Taga | |
| 4,826,550 | A | 5/1989 | Shimizu et al. | |
| 4,827,105 | A * | 5/1989 | Brown, Jr. | A45D 20/12 219/222 |
| 4,860,556 | A * | 8/1989 | Hammett | F04D 29/5826 62/406 |
| 4,879,880 | A * | 11/1989 | Harrison | F04D 29/582 165/86 |
| 4,917,643 | A | 4/1990 | Hippely et al. | |
| 5,011,445 | A * | 4/1991 | Nakasuji | A63H 33/22 401/1 |

(Continued)

FOREIGN PATENT DOCUMENTS

| | | |
|---|---|---|
| GB | 2205255 A | 12/1988 |
| JP | 6-39152 A | 2/1994 |

(Continued)

*Primary Examiner* — Gene Kim
*Assistant Examiner* — Alyssa Hylinski
(74) *Attorney, Agent, or Firm* — Edell, Shapiro & Finnan, LLC

(57) ABSTRACT

A toy assembly includes an air blower than can blow air and particles such as glitter. In one embodiment, the toy assembly includes a doll and an air blower that can blow air and glitter particles as well as change the color of the hair of the doll.

17 Claims, 23 Drawing Sheets

(56) References Cited

U.S. PATENT DOCUMENTS 5,015,211 A 5/1991 Reveen
5,085,607 A 2/1992 Shibahashi et al.
5,121,463 A * 6/1992 Yoshihara ..... A45D 20/124 239/101
5,136,850 A * 8/1992 Bierschenk ..... F25B 21/02 132/118
5,149,290 A 9/1992 Reveen
5,180,324 A 1/1993 Simmons
5,215,491 A 6/1993 Willet et al.
5,223,958 A 6/1993 Berry
5,234,370 A 8/1993 Shapero et al.
5,338,242 A 8/1994 Cheng
5,351,890 A 10/1994 Clements
5,376,772 A * 12/1994 Nakagawa ..... H05B 3/141 219/221
5,394,620 A * 3/1995 Chimera ..... A45D 20/30 34/97
5,421,765 A 6/1995 Lehmann et al.
5,503,583 A * 4/1996 Hippely ..... A63H 33/22 446/14
5,518,433 A 5/1996 Sneddon
5,553,632 A * 9/1996 Burkhardt ..... A45D 20/50 132/144
5,582,532 A * 12/1996 Tucker ..... A63H 37/00 239/226
5,586,923 A 12/1996 Hippely et al.
5,649,370 A * 7/1997 Russo ..... A45D 20/12 34/97
5,695,834 A 12/1997 Sheets
5,698,263 A 12/1997 Sheets
5,716,253 A * 2/1998 Aoki ..... A63H 33/3055 446/14
5,723,178 A 3/1998 Sheets
5,761,824 A * 6/1998 Moon ..... A45D 20/12 34/97
5,843,415 A * 12/1998 Klar ..... A61K 8/8182 424/70.1
5,860,293 A * 1/1999 Piro ..... F04D 29/5826 62/420
5,871,385 A 2/1999 Hippely et al.
6,120,346 A 9/2000 Wang
6,192,702 B1 * 2/2001 Shimogori ..... F24F 1/04 62/259.3
6,260,989 B1 7/2001 Ingraselino
6,299,502 B1 10/2001 Cheng
6,346,024 B1 2/2002 Engel
6,447,364 B1 9/2002 Song
6,468,126 B1 10/2002 Herber
6,475,609 B1 * 11/2002 Whitney ..... B32B 7/02 428/212
6,503,582 B1 1/2003 Nardoza et al.
6,572,435 B1 6/2003 Wong
6,585,555 B2 7/2003 Wong et al.
6,669,530 B2 12/2003 Du
6,719,603 B2 4/2004 Chan
6,736,692 B1 * 5/2004 Hoyos-Zermeno ..... A63H 3/44 446/296
6,749,935 B2 6/2004 Ishimura
6,751,886 B2 * 6/2004 Chang ..... A45D 20/50 34/96
6,792,692 B1 * 9/2004 Takizawa ..... A45D 20/12 34/283
7,282,671 B1 10/2007 Hamilton
8,342,900 B2 * 1/2013 Kane ..... A63H 3/52 40/410
2001/0053654 A1 12/2001 Watkins
2003/0087580 A1 * 5/2003 Shibahashi ..... A63F 3/0685 446/14
2003/0194941 A1 10/2003 Janning
2006/0046613 A1 3/2006 Mann
2006/0199469 A1 9/2006 Du
2007/0123808 A1 * 5/2007 Rhoades ..... A45D 24/007 601/73
2007/0149091 A1 6/2007 Viohl
2007/0155280 A1 7/2007 Patean et al.
2007/0249261 A1 10/2007 Norman
2007/0259592 A1 11/2007 Imai et al.
2007/0259593 A1 11/2007 Imai
2008/0014828 A1 1/2008 Kelly
2008/0293324 A1 11/2008 Friedland
2008/0293326 A1 11/2008 Ishimura
2009/0188125 A1 * 7/2009 Fung ..... A45D 20/124 34/68
2009/0282690 A1 * 11/2009 Lee ..... A45D 20/12 34/97

FOREIGN PATENT DOCUMENTS

JP 7-241389 A 9/1995
JP 9-56937 A 3/1997
JP 9-276559 A 10/1997
JP 9-276560 A 10/1997
JP 10-33841 A 2/1998
JP 2000-116969 A 4/2000
JP 2004-321668 A 11/2004

* cited by examiner

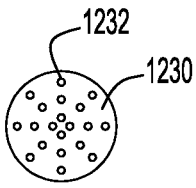
FIG.29
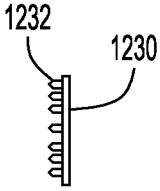
FIG.30
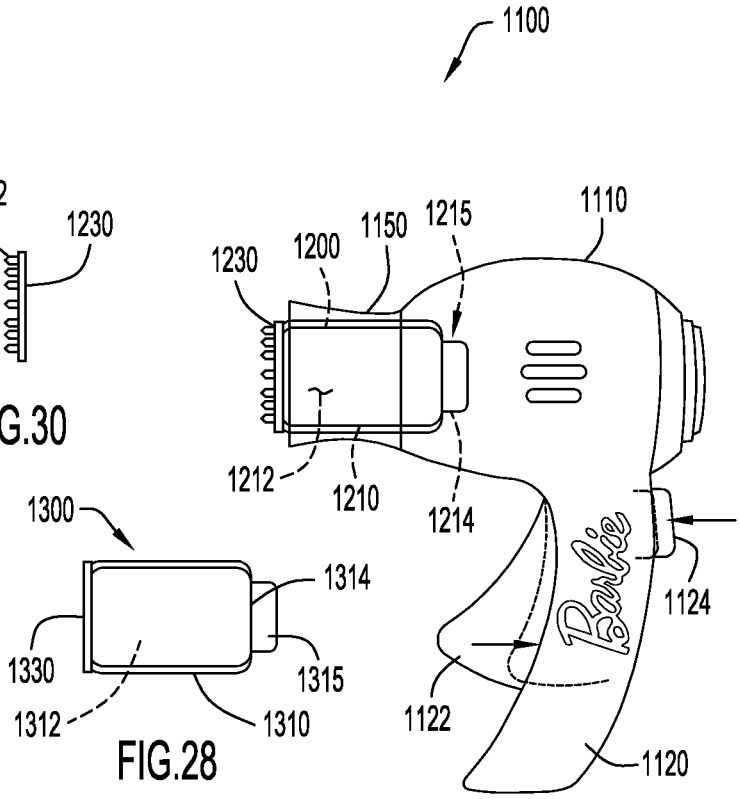
FIG.28
FIG.27

TOY ASSEMBLY WITH BLOWER AND COLOR CHANGING FEATURES

CROSS-REFERENCE TO RELATED APPLICATION

This application is a divisional application of U.S. patent application Ser. No. 13/212,326, filed Aug. 18, 2011, entitled "Toy Assembly with Blower and Color Changing Features," which claims priority to and the benefit of Provisional Patent Application No. 61/374,816, filed Aug. 18, 2010, entitled "Toy Assembly with Blower and Color Changing Features,". The entire disclosure of each of these applications is incorporated by reference herein in its entirety.

FIELD OF THE INVENTION

The present invention relates to a toy assembly, and in particular, a toy assembly including an air blower than can blow air and particles, such as glitter. The present invention also relates to a toy assembly including a doll and an air blower that can blow air and glitter particles as well as change the color of the hair of the doll.

BACKGROUND OF THE INVENTION

Some conventional dolls have hair that is thermochromic. The color of the doll's hair can be changed by the application of a cold object or a warm object to the hair. In one example, the application of heat through the contact of a warm object with thermochromic hair of the doll can result in the doll's hair changing from a first color to a different, second color. The application of cold energy through the contact of a cold object with the doll's hair can change the hair from the second color back to the first color.

Some conventional toys are configured to blow air. Blowing air alone is repetitive and lacks any creativity on the part of the child playing with the blower.

However, such toys are not configured to blow air and particles that are decorative, such as glitter. The ability of a blower to blow particles in addition to air would facilitate the decoration of a doll or other object.

Therefore, there is a need for an air blower than can blow air and particles, such as glitter. There is also a need for an air blower that can be used to change the color of a doll's hair as well as dispense air and particles.

SUMMARY OF THE INVENTION

In one embodiment, a toy assembly includes a doll and a blower that can be used to blow air and/or particles, such as glitter particles, at the doll. The doll may have a tacky surface or a gel or sticker can be added to the doll to provide a tacky or adhesive surface to which the particles can adhered. The tacky surface(s) on the doll can vary, thereby creating a different appearance for the doll when the glitter particles are applied to the doll. In one implementation, the glitter particles can be applied to the hair of the doll.

In one embodiment, the blower has multiple modes of operation. In one mode of operation, the blower can be used to blow air at the doll, such as to "blow dry" the doll's hair. In another mode of operation, the blower can be used to dispense glitter particles as well as blow air. The dispensing or dispersing of the glitter particles can be controlled or metered to provide a desired amount of glitter from the blower. In one implementation, the blower includes a bellows structure that provides periodic bursts of air that flow past a source of glitter particles to carry glitter particles from the blower. The bellows structure is periodically compressed by an actuator to provide the actuations of the bellows needed for the air flow. In one embodiment, the glitter particles can be fed into a supply tube from a hopper. In another embodiment, the glitter particles falling into the supply tube can be controlled by a valve-like structure.

In one embodiment, the blower can have different components attached thereto that can be brought into engagement with the hair of a doll to change the color of the portion of the hair of the doll that is thermochromic. In one arrangement, a cooling component can be attached to the blower. In another arrangement, a heating component can be attached to the blower. The components can be filled with the corresponding one of a cold or warm liquid, such as water, or a solid, such as ice cubes. The components can be brought into contact with the hair of the doll to change its color.

In one embodiment, the blower can change the color of the doll's hair as well as blow air and/or glitter particles on the doll. This combined functionality provides many different opportunities for the decorating of and the playing with a doll by a child.

BRIEF DESCRIPTION OF THE DRAWINGS

FIG. 27 illustrates a side view of another embodiment of a blower according to the invention.

FIG. 28 illustrates a side view of a component for use with the blower illustrated in FIG. 27.

FIG. 29 illustrates a front view of a plate for use with the blower illustrated in FIG. 27.

FIG. 30 illustrates a side view of the plate illustrated in FIG. 29.

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "dispensing," "dispersing," "expelling," "outputting," and "distributing" may be used interchangeably herein to refer to how air and/or particles exit the housing of the blower. The terms "blower," "blowing mechanism," and "air flow generating mechanism" may be used interchangeably herein to refer to a mechanism that generates a flow of air, whether continuous or intermittent.

Figure 1:
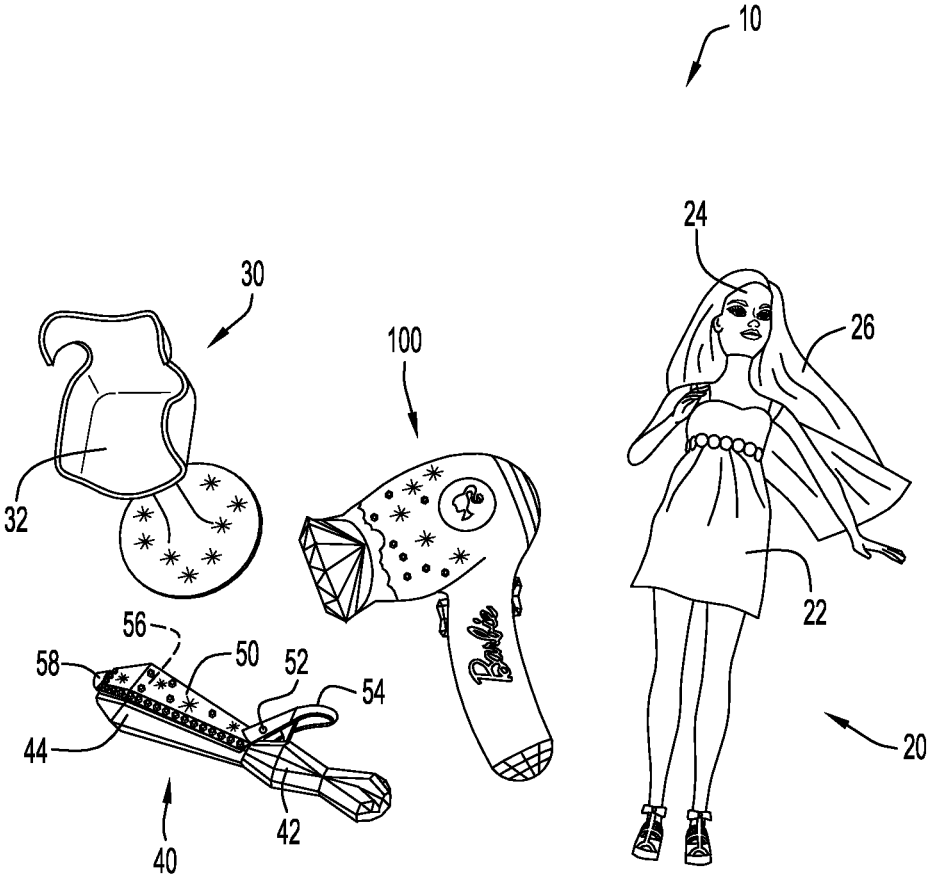
FIG. 1 illustrates a perspective view of the various components of an embodiment of a toy assembly according to the present invention.

Referring to FIG. 1, an embodiment of a toy assembly according to the present invention is illustrated. In this embodiment, the toy assembly 10 includes a doll 20 that has a body 22, a head 24, and hair 26 coupled to the head 24. In this embodiment, the hair 26 has thermochromic properties, which enable a user to change the color of the hair 26 by applying heat or a cold object to the hair 26. The arms and legs of the doll 20 can be fixed or movable in different embodiments. The toy assembly 10 also includes a chair structure 30 that has a seat 32 in which the doll 20 can be placed.

Figure 2:
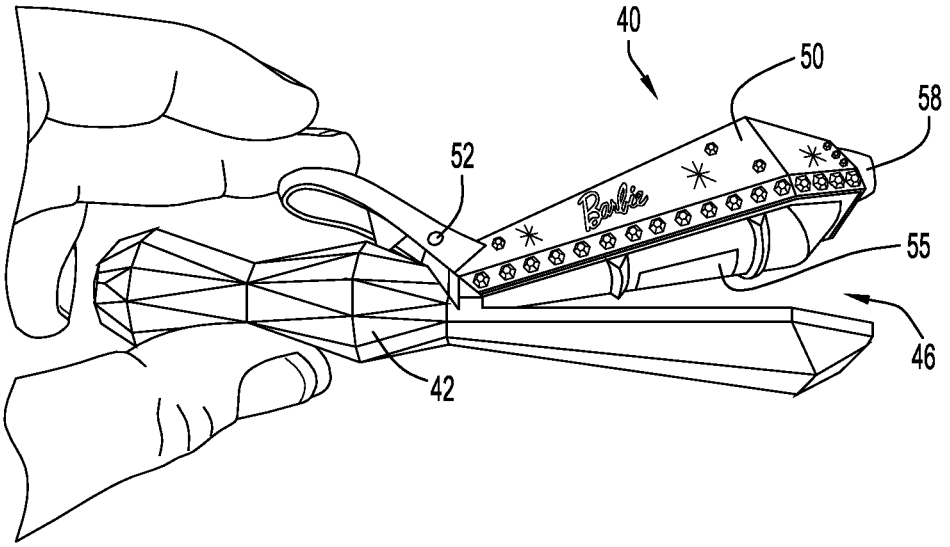
FIG. 2 illustrates a side view of a color changing apparatus of the toy assembly illustrated in FIG. 1.

In addition, the toy assembly 10 includes a color changing mechanism 40, which is shown in FIGS. 1 and 2. In this embodiment, the color changing mechanism 40 includes a handle 42 and extending portion 44 that are formed of plastic. Pivotally coupled to the handle 42 is a movable jaw 50 that is mounted on protrusions 52 on opposite sides of the handle 42. The jaw 50 includes a lever 54 and a body portion having a receptacle 56 that can be filled with a cold liquid or a hot liquid through an opening with a removable plug 58 that can be inserted into the opening to seal the receptacle 56. As shown in FIG. 2, the jaw 50 includes a metallic contact surface 55 that is in communication with the liquid in the receptacle 56 and that can conduct the warm or cold energy of the liquid to hair 26 of the doll 20 that is placed in the space 46 between the jaw 50 and the extending portion 44. The child can slide the color changing mechanism 40 along the hair 26 of the doll 20 to change its color.

Referring back to FIG. 1, the toy assembly 10 includes a blower or blowing device 100, which is described in greater detail below. The blower 100 is configured to blow air and particles, such as glitter particles, when activated by the user. In this embodiment, the blower 100 resembles a hair dryer.

Referring to FIGS. 3-6, front, rear, and opposite side views of the blower 100 are illustrated. As shown, the blower 100 includes a housing 110 that is formed by two housing portions 112 and 114 (see FIG. 4) that are coupled together using conventional fasteners such as screws. In one embodiment, each of the housing portions 112 and 114 is approximately half of the housing 110. The housing portions 112 and 114 define the opposite sides or side portions 120 and 122, respectively, (see FIGS. 4 and 5) of the housing 110. The housing 110 also has a front end 116 and an opposite, rear end 118 (see FIG. 3).

Figure 3:
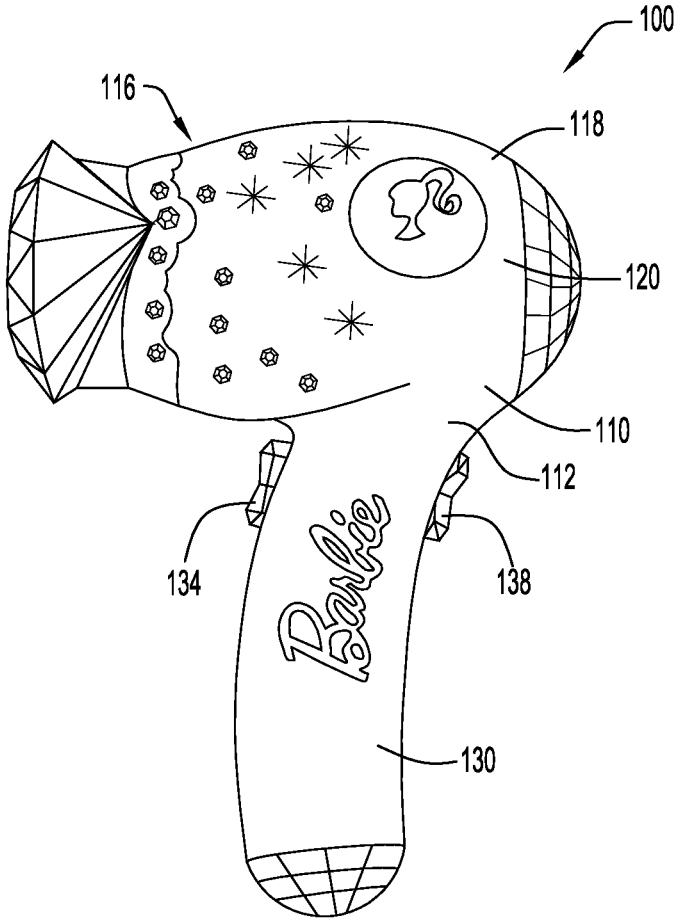
FIG. 3 illustrates a side view of a blower of the toy assembly illustrated in FIG. 1.

As shown in FIG. 3, the housing 110 has a handle portion 130 that has a pair of switches 134 and 138 movably coupled thereto. Switch 134 is an activation switch that is connected to an internal drive mechanism that causes air to be expelled or output from the housing 110. When a user presses switch 134 inwardly, the drive is activated and an air flow from the blower 100 is generated. As described below, if the mode of operation of the blower 100 that distributes air and particles is selected, then both air and particles are dispensed when switch 134 is activated.

Figure 4:
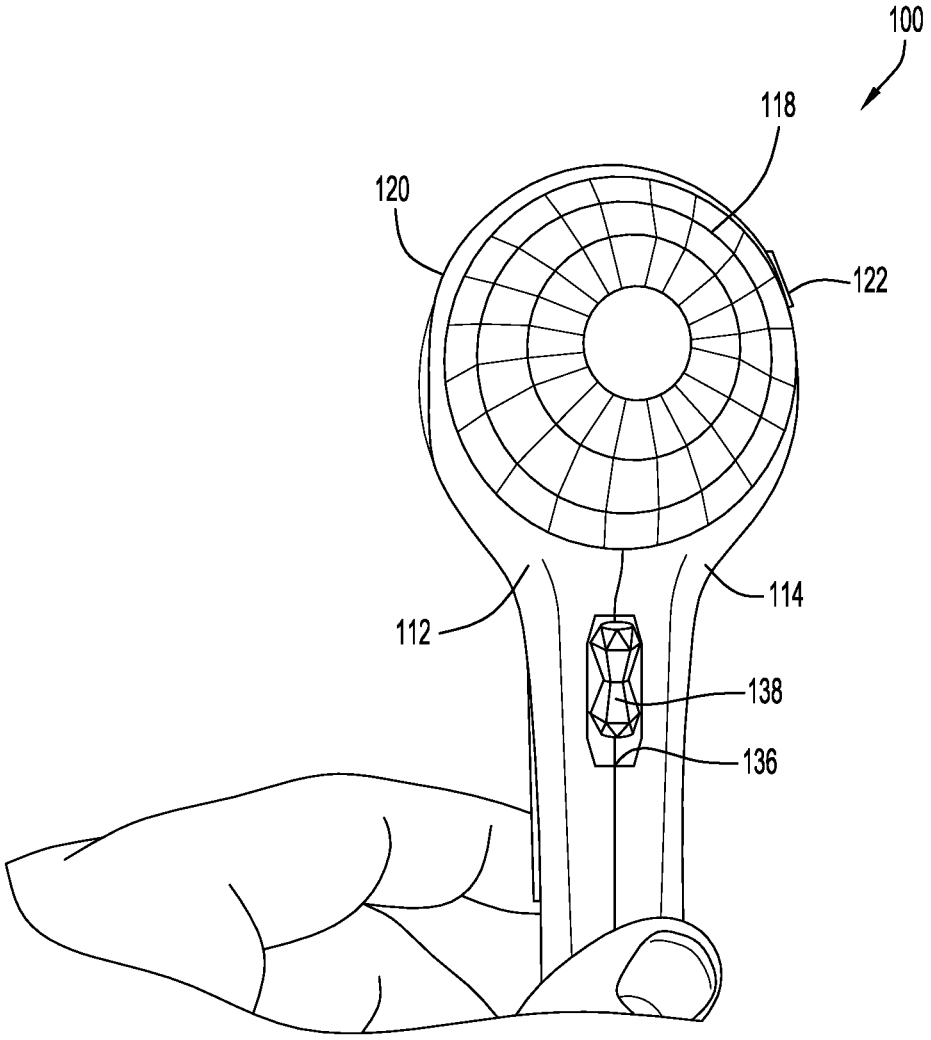
FIG. 4 illustrates a rear view of the blower illustrated in FIG. 3.
Figure 5:
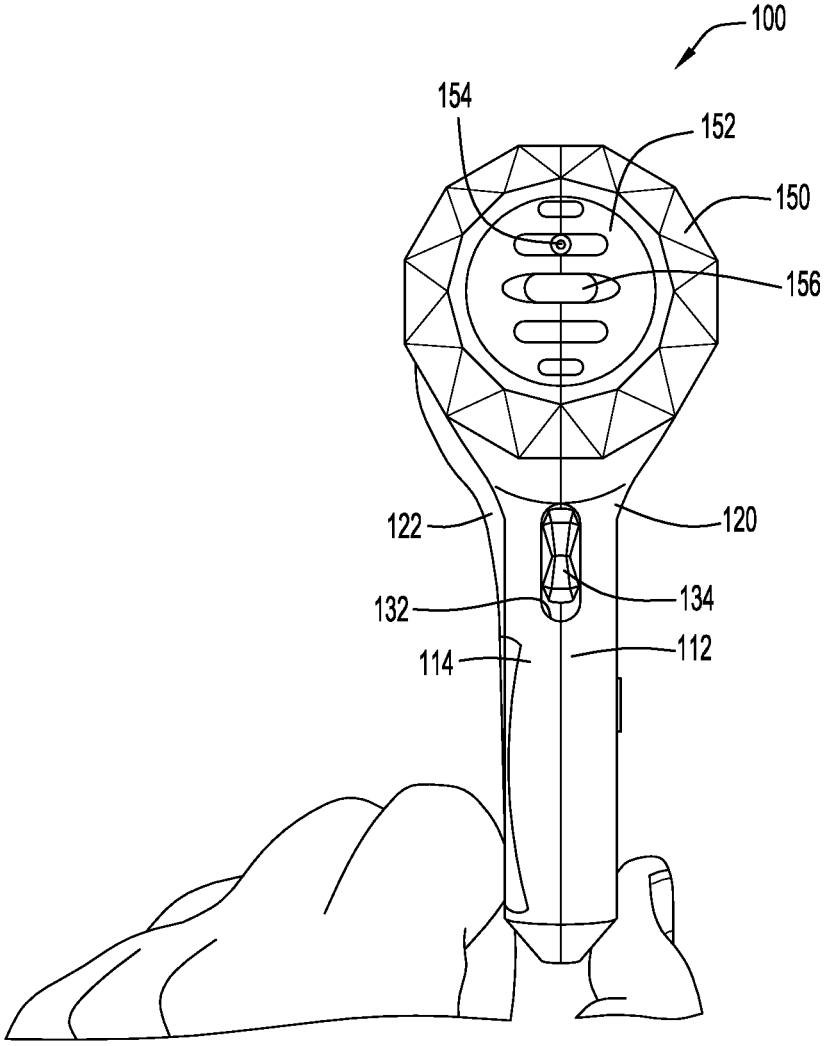
FIG. 5 illustrates a front view of the blower illustrated in FIG. 3.

Switch 138 is a mode switch that can be manipulated by a user to: (a) turn the blower 100 off; (b) operate the blower 100 in an air blowing mode; or (c) operate the blower 100 in a combined air blowing and particle dispersing mode. As shown in FIGS. 4 and 5, switches 134 and 138 are located within openings 132 and 136, respectively, that are formed in the housing 110 of the blower 100.

Referring to FIG. 5, the housing 110 includes a nozzle portion 150 removably coupled thereto. In this embodiment, the nozzle portion 150 includes a front surface 152 and openings 154 and 156 that extend through the front surface 152. Air exits the blower 100 through opening 156 and particles, such as glitter, exits through opening 154. The particles from opening 154 are located above the air from opening 156 and as a result, becoming entrained in the air flow which results in the distribution of the particles. The air flow from opening 156 can carry the particles from opening 154 to a desired location, such as a surface on a toy doll.

Figure 6:
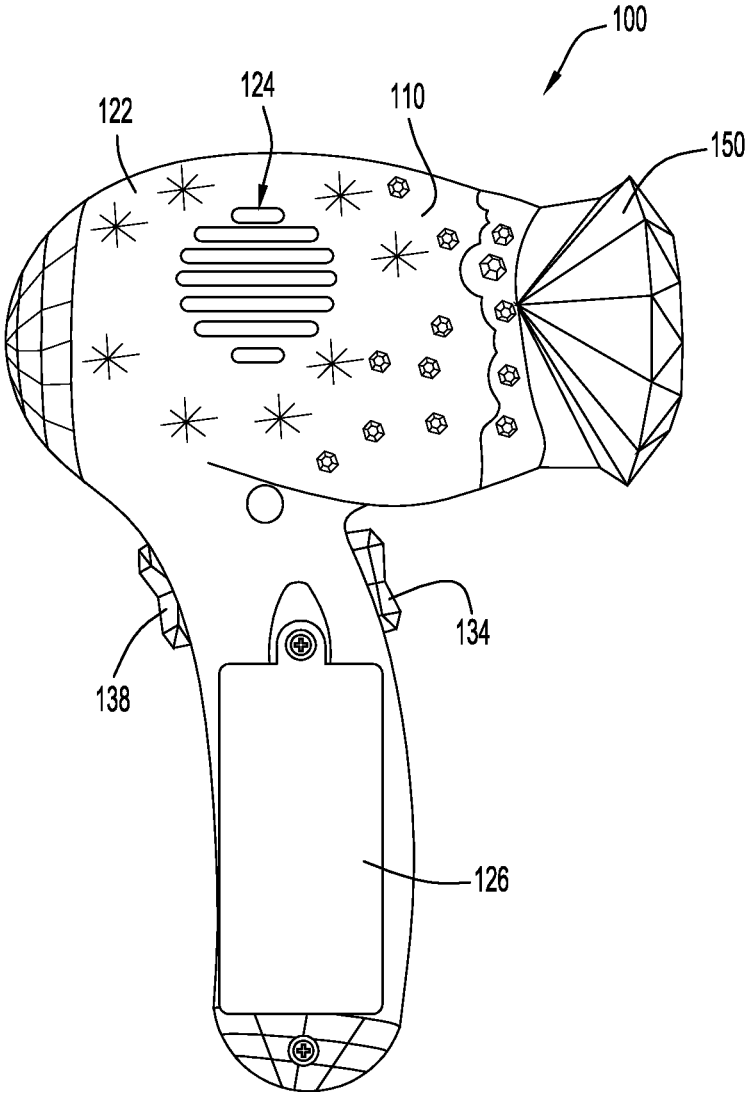
FIG. 6 illustrates a side view of the blower illustrated in FIG. 3.

Referring to FIG. 6, the housing 110 includes several openings 124 formed in side portion 122 that allow air to be drawn therethrough from the outside of the blower 100 to inside of the housing 110. The quantity and shapes of the openings 124 can vary. The handle 130 includes a battery compartment door 126 that covers a battery component, which is described below.

Figure 7:
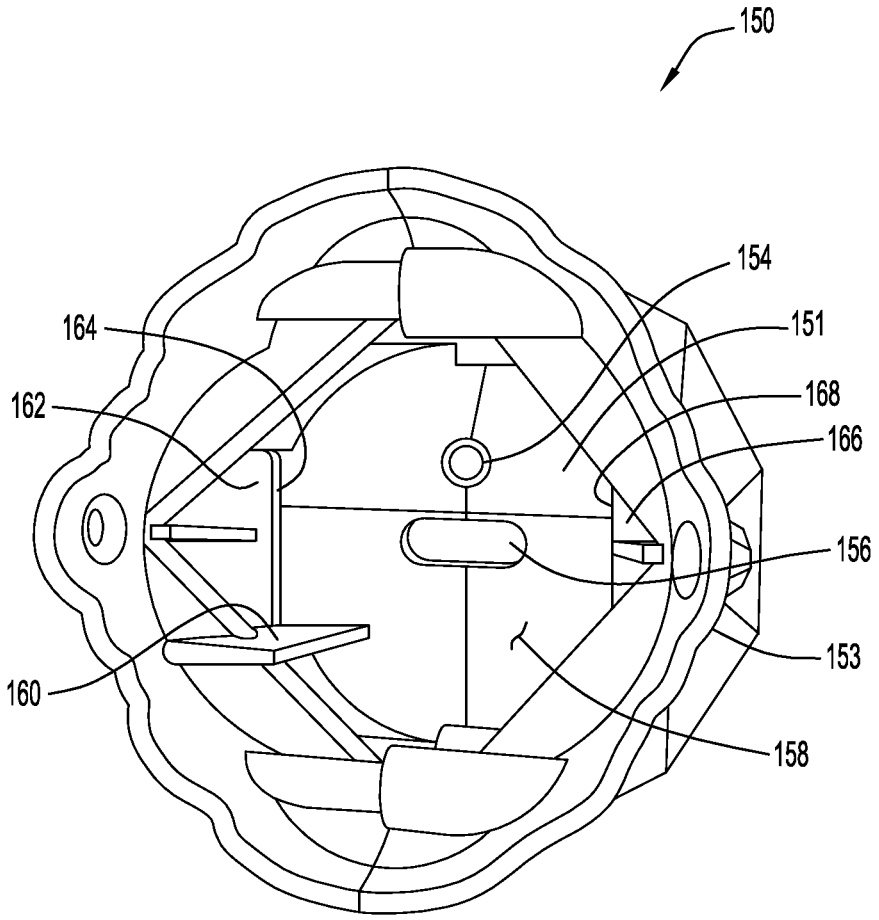
FIG. 7 illustrates a perspective view of the inside of a nozzle portion of the blower illustrated in FIG. 3.

Referring to FIG. 7, an embodiment of a nozzle portion according to the invention is illustrated. In this embodiment, the nozzle portion 150 includes an inner surface 151 opposite to the outer or front surface 152 and the openings 154 and 156 extend between the surfaces 151 and 152. The nozzle portion 150 also includes a wall 153 that defines an interior region or receptacle 158. Formed on opposite sides of the wall 153 are ledges 162 and 166 with edges 164 and 168, respectively, that extend inwardly from the wall 153. The ledges 162 and 166 engage catches or coupling members formed on opposite sides of the housing 110 (as described below relative to FIG. 8) to releaseably couple the nozzle portion 150 to the housing 110.

The nozzle portion 150 also includes a locating mechanism 160 that engages a slot formed on the housing 110 to ensure that the nozzle portion 150 is mounted on the housing 110 in the proper orientation. In this embodiment, the locating mechanism 160 is in the form of a plate that extends into the receptacle 158.

Figure 8:
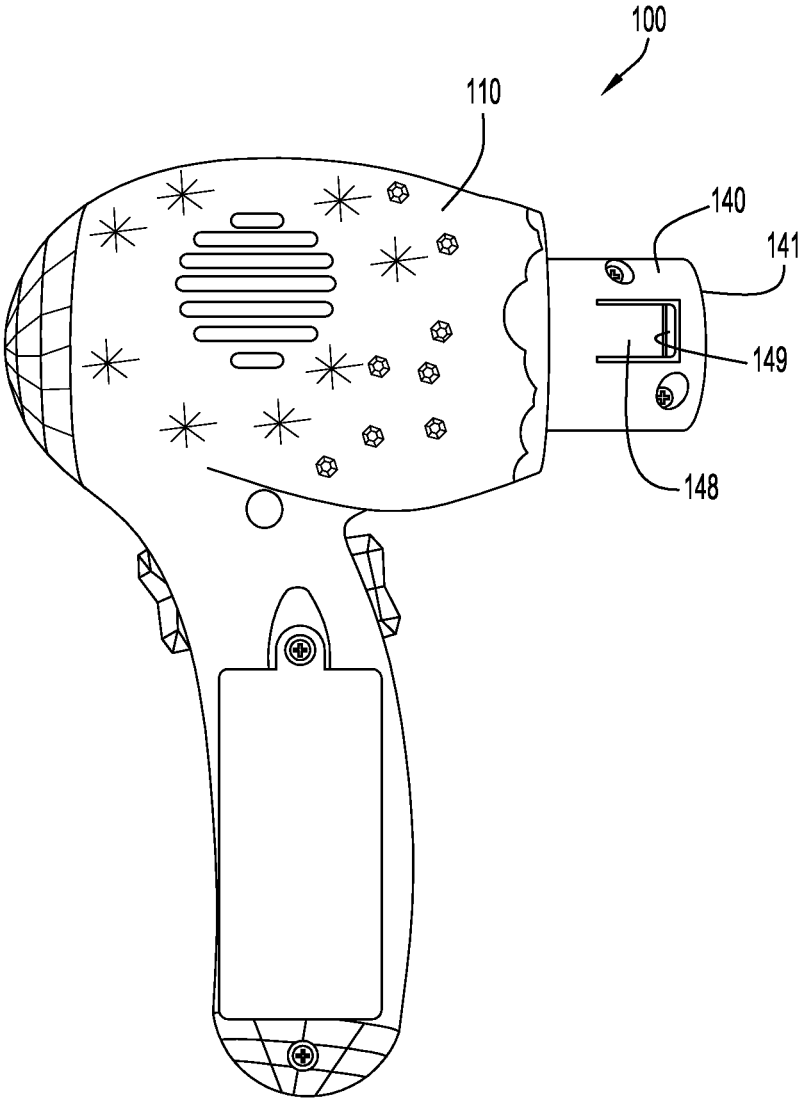
FIG. 8 illustrates a side view of the blower illustrated in FIG. 3 with its nozzle portion removed.
Figure 9:
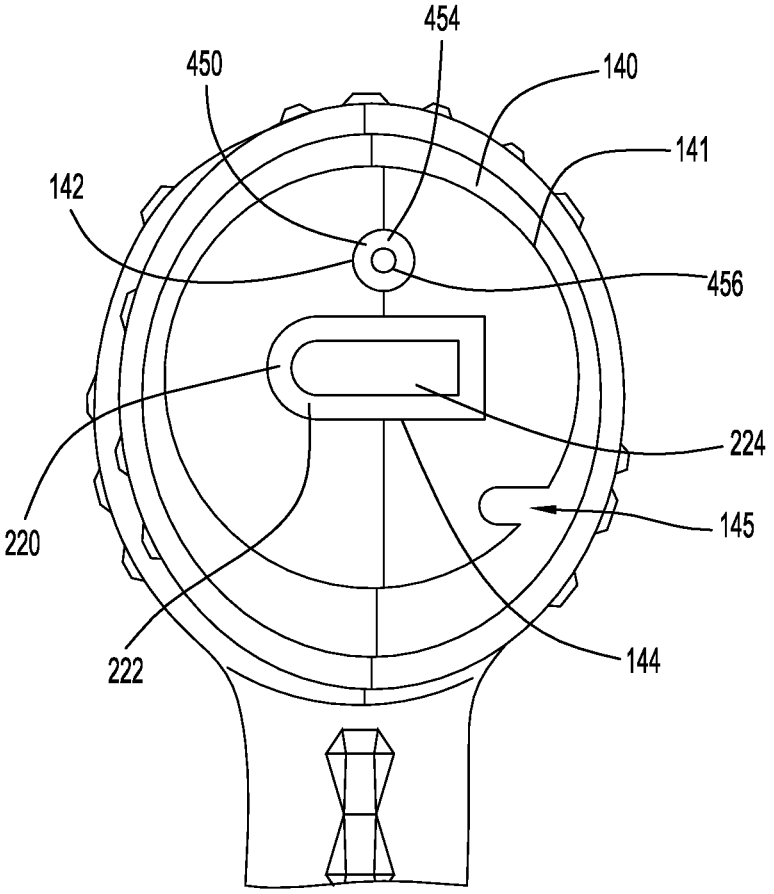
FIG. 9 illustrates a front view of the front end of the blower illustrated in FIG. 8.

Referring to FIGS. 8 and 9, the housing 110 is illustrated with the nozzle portion 150 removed. The housing 110 includes an end portion 140 that extends forwardly from the main body of the housing 110. The end portion 140 includes an end surface 141 and coupling members located on opposite sides of the end portion 140 (only coupling member 148 is illustrated in FIG. 8). The coupling members are similar in structure and configuration. Each coupling member 148 is a resiliently mounted tab with a lip 149 proximate to its free end. When the nozzle portion 150 is slid onto the end portion 140, the lips 149 of the coupling members engage the ledges 162 and 166 and pass over the corresponding edges 164 and 168. Once past the edges 164 and 168, the lips 149 engage the ledges 162 and 166 to releaseably couple the nozzle portion 150 to the end portion 140.

Referring to FIG. 9, a front view of the end portion 140 of the housing 110 is illustrated. The end portion 140 includes openings 142 and 144 formed therein which are aligned with openings 154 and 156, respectively, when the nozzle portion 150 is mounted on the end portion 140. Opening 142 of the end portion 140 is sized so that the end surface 454 of a nozzle 450 is exposed. As described in greater detail below, the nozzle 450 includes an opening 456 through which particles can pass. Opening 144 is sized so that the end surface 222 of a tube or delivery member 220 is exposed. The end surface 222 defines an opening 224 through which air flows from the housing 110.

The end portion 140 includes a slot 145 formed therein that receives the plate or guide 160 of the nozzle portion 150 to ensure that the nozzle portion 150 is mounted on the end portion 140 in its proper orientation.

Figure 10:
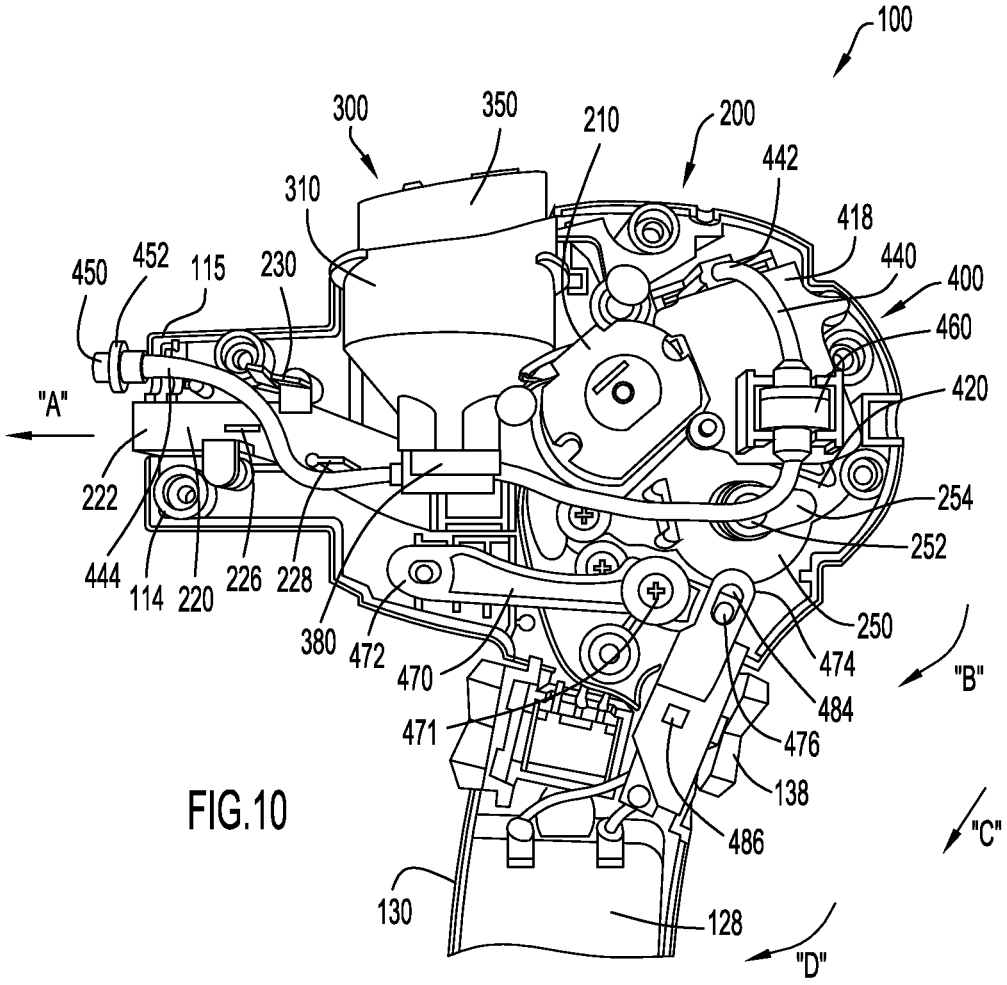
FIG. 10 illustrates a side view of the blower illustrated in FIG. 3 with one of its housing portions removed.

Referring to FIG. 10, housing portion 112 has been removed so that the internal components of the blower 100 can be viewed. The blower 100 includes a blowing mechanism 200 that has a drive or motor 210 that is powered by a power source, such as one or more batteries, located in the battery component 128 in the handle 130. The drive 210 is operably coupled to a blower mechanism (shown in FIG. 13 and described below) and to a drive or gear mechanism located in drive or gear housing 250. The gear mechanism is coupled to output member 252, such as an axle, to which a cam 254 is coupled, as described below.

The blower 100 has two modes of operation. In one mode, corresponding to an air only mode, the drive 210 causes the blower mechanism to operate and air is dispensed through the output tube 220 and out of the blower 100 through the opening at end 222. In the other mode, corresponding to an air and particle mode, in addition to the air being blown out from the blower 100, particles are also dispensed from the blower 100 by the particle feeding or particle control mechanism 400, which is activated by the cam 254. Mechanism 400 can be referred to alternatively as a particle flow generating mechanism.

When the drive 210 is operating, air is blown out through tube or delivery member 220 to end 222 along the direction of arrow "A." When the particle feeding mechanism 400 is activated, by way of the mode switch, the cam 254 rotates about axle 252 along the direction of arrow "B" and engages an actuator 420 which causes periodic distribution of particles, as described below. In this embodiment, when the mode switch 138 is moved downwardly along the direction of arrow "C," an elongate member or lever 470 rotates about pivot axis defined by connector 471 along the direction of arrow "D" and the mode in which air and particles are dispensed is selected.

Figure 11:
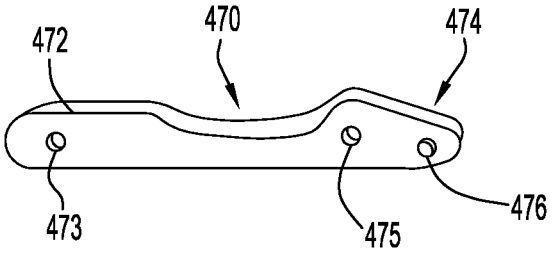
FIG. 11 illustrates a side perspective view of a lever of the blower illustrated in FIG. 10.

Referring to FIG. 11, the elongate member 470 has opposite ends 472 and 474. In end 472, an opening 473 is formed for receipt of a projection from a guide member. Along the body of the lever 470 is an opening 475 that receives the connector or coupler 471, such as a screw, that pivotally mounts the lever 470 to the housing 110. A projection 476 extends outwardly from a side of the lever 470.

Referring back to FIG. 10, the blower 100 includes a container or particle supply 300 which has a housing 350 removably inserted into a hopper 310. The hopper 310 is connected at its lower end to a coupler 380 that is in communication with a tube 440 that delivers particles relative to the housing 110. The tube 440 is held in place between several guide projections 226, 228, and 230 that are formed on tube 220. The tube 440 has a proximal end 442 and an opposite, distal end 444. At the distal end 444 is a nozzle 450 with a ridge 452 that can be captured in a groove 115 that is formed in housing portion 114. The tube proximate end 442 is coupled to a bellows structure (described below) that is contracted to provide periodic or intermittent bursts or pulses of air that pass through the tube 440 from end 442 toward end 444, and that exit the nozzle 450 along the direction of arrow "A" with particles therein. In this embodiment, the tube 440 includes a valve 460 that prevents the particles from being drawn back into the bellows structure as the bellows expands. Also shown in FIG. 10 is a plate 418 that is mounted to housing portion 114 and that provides a cover for the actuator 420.

Figure 12:
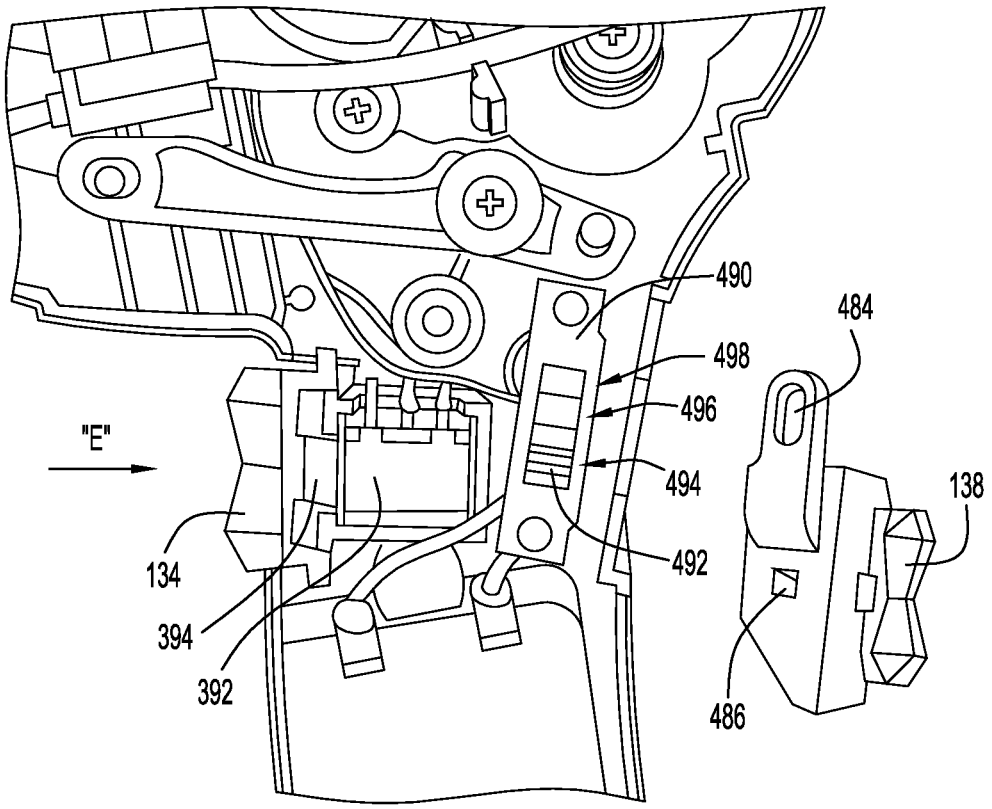
FIG. 12 illustrates a close-up side view of some of the components of the blower illustrated in FIG. 10.

Referring to FIGS. 10 and 12, switch 134 is coupled to a switch portion 394 that extends from a switch body 392. In FIG. 12, the switch 138 has been removed from the housing portion 114, thereby revealing a switch body 490 with a movable switch member 492 that has a position 494 corresponding to an operational mode in which both air and glitter particles are dispersed, another position 496 in which the blower 100 is turned off, and another position 498 corresponding to another operational mode in which only air is dispersed. The difference between the two operational modes is that particles are periodically or intermittently blown from the housing 110 when position 494 is selected and not when position 498 is selected. When a user presses inward on switch 134 along the direction of arrow "E" in FIG. 12, the drive 210 is activated, provided that the blower 100 has been put into either of its operational modes described above.

As shown in FIG. 12, switch 138 includes openings 484 and 486 formed therein. Opening 484 is configured to receive projection 476 on lever 470 to move the lever 470 as the switch 138 is moved (see FIG. 10). Opening 486 is configured to receive the switch extension 492 to couple the switch extension 492 and the switch 138 together.

Figure 13:
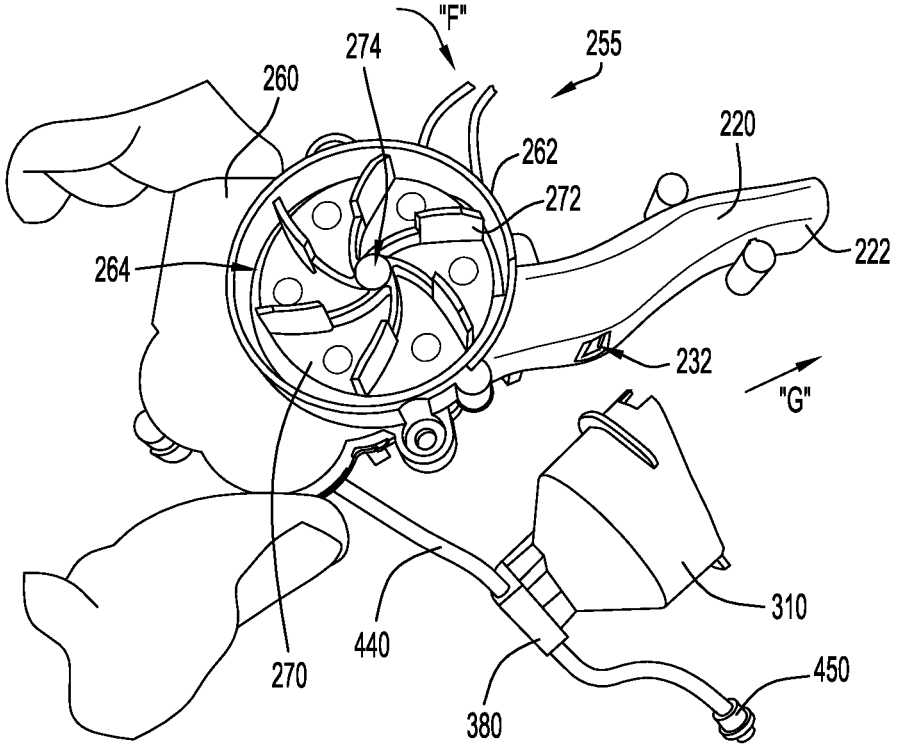
FIG. 13 illustrates a side view of the blower mechanism of the blower illustrated in FIG. 10.

Referring to FIG. 13, a perspective view of a blower mechanism of the blower 100 is illustrated. In this embodiment, the blower mechanism 255 includes a housing 260 with a wall 262 defining a receptacle 264. Mounted to the housing 260 for rotation along the direction of arrow "F" about axis 274 is an impeller 270 with several blades 272. When rotating, the impeller 270 pushes air along the direction of arrow "G" through tubular member 220 toward end 222. The tubular member 220 also includes an opening 232 formed therein through which air can be pulled into the tubular member 220. Also shown in FIG. 13 are the hopper 310 with coupler 380, the tube 440, and nozzle 450.

Figure 14:
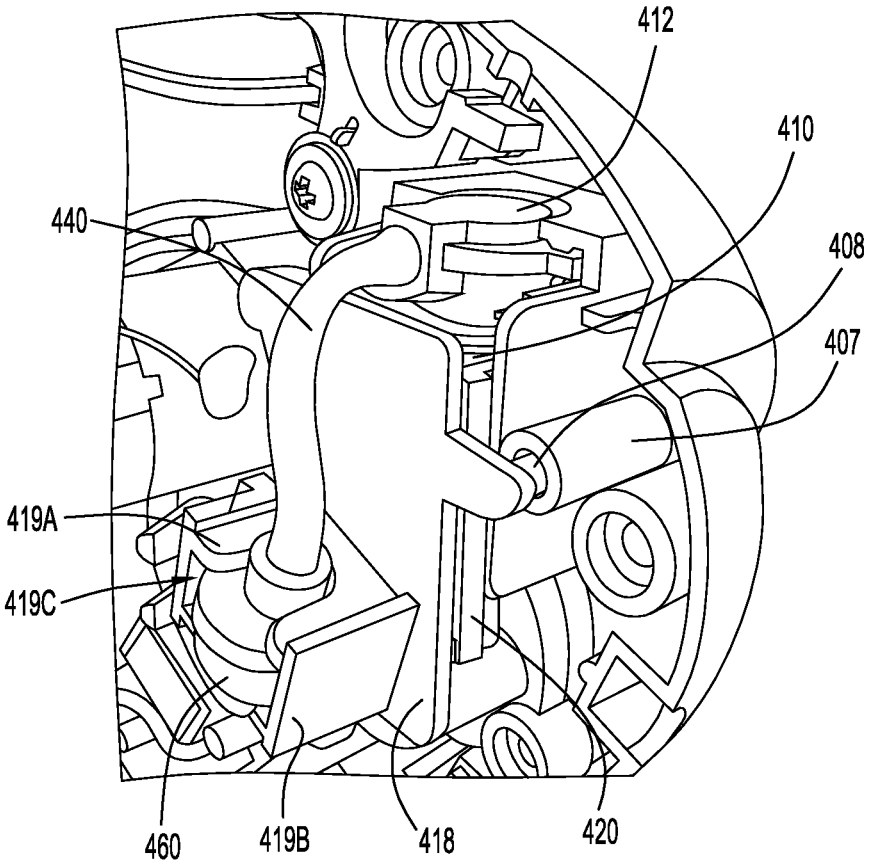
FIG. 14 illustrates a rear perspective view of some of the components of the blower illustrated in FIG. 10.

Referring to FIG. 14, some of the components relating to the distribution of the particles are illustrated. The air pump or bellows 410 is operably connected to a port 412 so that when the bellows 410 is compressed, air is forced from the bellows 410 into the port 412 and into the tube 440.

As shown, the plate 418 has projections 408 that are inserted into mounting posts 407 with openings to mount the plate 418, which is proximate to actuator 420. The plate 418 includes a pair of walls 419A and 419B that define an area or cavity 419C therebetween. The area 419C is sized so that the valve 460 can be inserted and retained therein.

Figure 15:
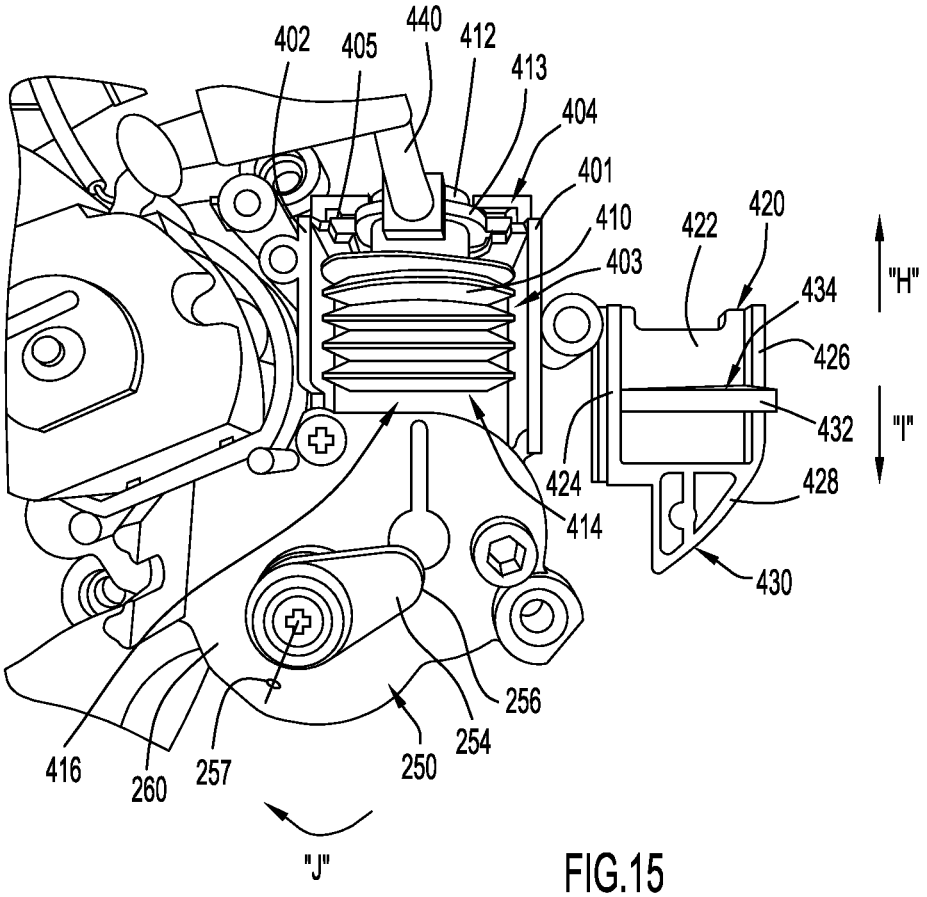
FIG. 15 illustrates a side view of the bellows of the blower illustrated in FIG. 14 with the actuator removed.
Figure 16:
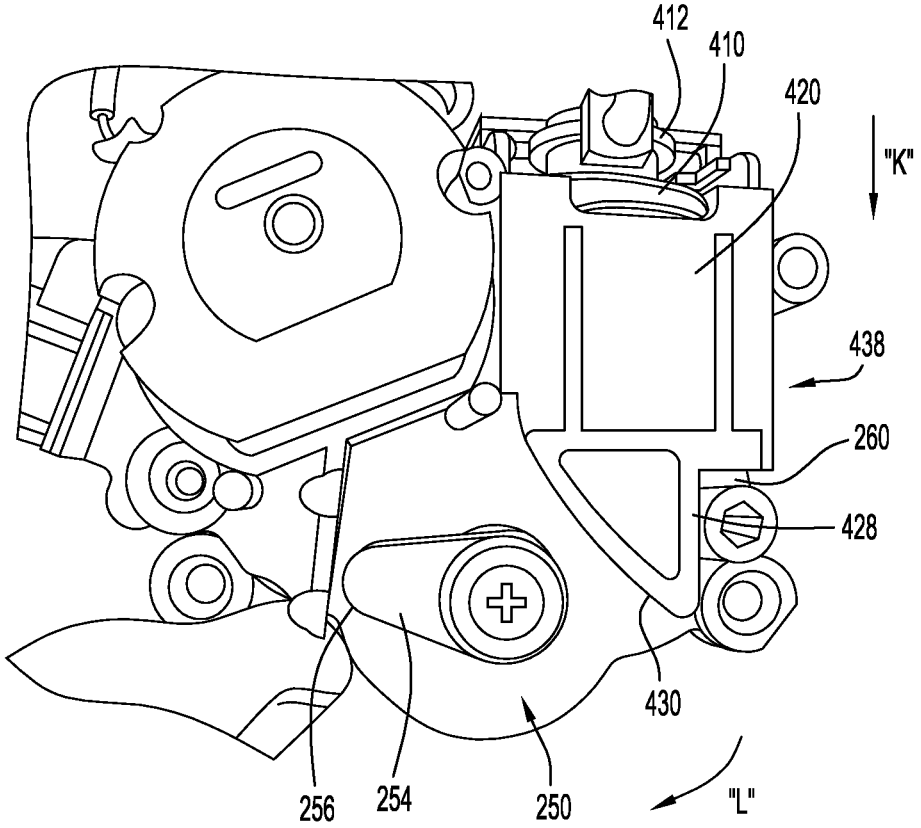
FIG. 16 illustrates a close-up side view of a cam disengaged from the bellows actuator of the blower illustrated in FIG. 15.
Figure 17:
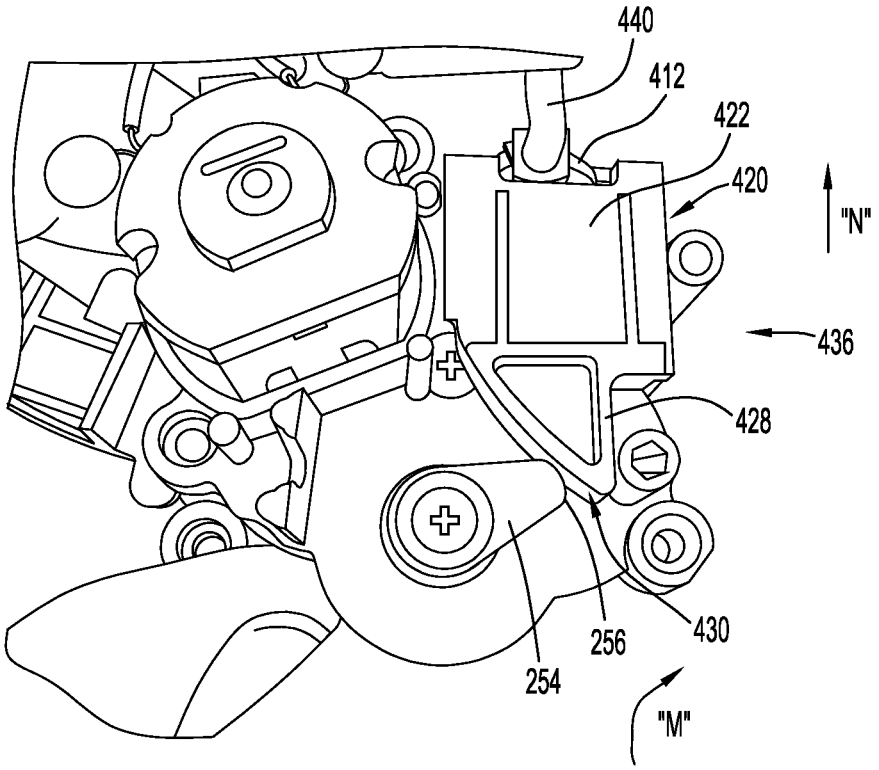
FIG. 17 illustrates a close-up side view of the cam engaged with the bellows actuator illustrated in FIG. 15.

Referring to FIGS. 15-17, the plate 418 has been removed from housing 260 so that the actuator 420 and bellows 410 can be viewed. The housing 260 includes a pair of plates or side walls 401 and 402 that define a chamber 403 therebetween. The chamber 403 has an upper end 404 with a groove 405 that can receive a flange 413 on the port 412 to mount the port 412. In the chamber 403 is a bellows 410 that is coupled to a port 412 at its upper end and has an opposite, lower end or surface 414. The port 412 is coupled to the tube 440, as previously mentioned. The bellows 410 can be compressed along the direction of arrow "H" and naturally expands along the direction of arrow "I." In this embodiment, the bellows 410 is compressed when the actuator 420 engages the lower surface 414 of the bellows 410 and moves it upwardly along the direction of arrow "H."

The inner surface of the actuator 420 is illustrated in FIG. 15. As shown, the actuator 420 includes a plate 422 with side walls 424 and 426 that slide along the inner surfaces of the walls 401 and 402 defining the chamber 403. The plate 422 has a lower end 428 with an engagement portion having a surface 430 that is periodically engaged by the outer cam surface 256 of the cam 254 as the cam rotates along the direction of arrow "J" about axis 257.

The actuator 420 includes a plate 432 that is inserted in the space 416 beneath the lower end 414 of the bellows 410. The plate 432 has a surface 434 that engages the lower end 414 of the bellows 410 and moves the lower end 414 as the actuator 420 is moved by the cam 254, which rotates relative to the gear housing 250.

Referring to FIGS. 16 and 17, the movement of the actuator 420 is described. Referring to FIG. 16, the actuator 420 is shown in its lowered or non-engaged position 438. In this position 438, the actuator 420 moves downwardly along the direction of arrow "K" under the force of gravity. In an alternative embodiment, a biasing mechanism, such as a spring, can be provided to bias the actuator along the direction of arrow "K." In this position, the engagement surface 430 of the actuator 420 is not contacted by the cam surface 256 of the cam 254.

This arrangement can represent one of two operational states. First, if the switch body 492 is in position 498, the mode of operation is that only air is being generated by the blower 100. In this mode, cam 254 is not driven by the drive 210 and is operably decoupled from the drive 210. In one embodiment, a gear can be moved out of engagement with a gear train, thereby decoupling the cam 254 from the drive 210. In another embodiment, a component other than a gear can be moved so as to decouple the cam 254 from the drive 210.

The other representative state is that if the switch body 492 is in position 494, the mode of operation is that air and particles are being blown from the blower 100. In this mode, cam 254 is continuously rotated about axis 257 along the direction of arrow "L" and due to the shape of the cam surface 256, the cam 254 intermittently engages the engagement surface 430 of the actuator 420. Thus, the position of the cam 254 in FIG. 16 corresponds to a non-engaging position during the rotation of the cam 254.

Referring to FIG. 17, as the cam 254 rotates along the direction of arrow "M," the cam surface 256 engages surface 430 on the lower end 428 of actuator 420 and moves the actuator 420 along the direction of arrow "N." As a result, the plate 432 of the actuator 420 moves along the same direction to position 436 and compresses the bellows 410, thereby forcing air through port 412 and into the tube 440. As the cam 254 continues to rotate, the cam surface 256 periodically engages and disengages the surface 430 of the actuator 420, thereby resulting in periodic bursts of air into the tube 440.

As the air is forced into the tube 440, the air pushes glitter particles that have dropped from the hopper 310 into the portion of the tube 440 at the coupler 380. The pushed glitter particles exit opening 154 in nozzle portion 150 and are carried further from the blower 100 by the airflow exiting opening 156 in nozzle portion 150.

Figure 18:
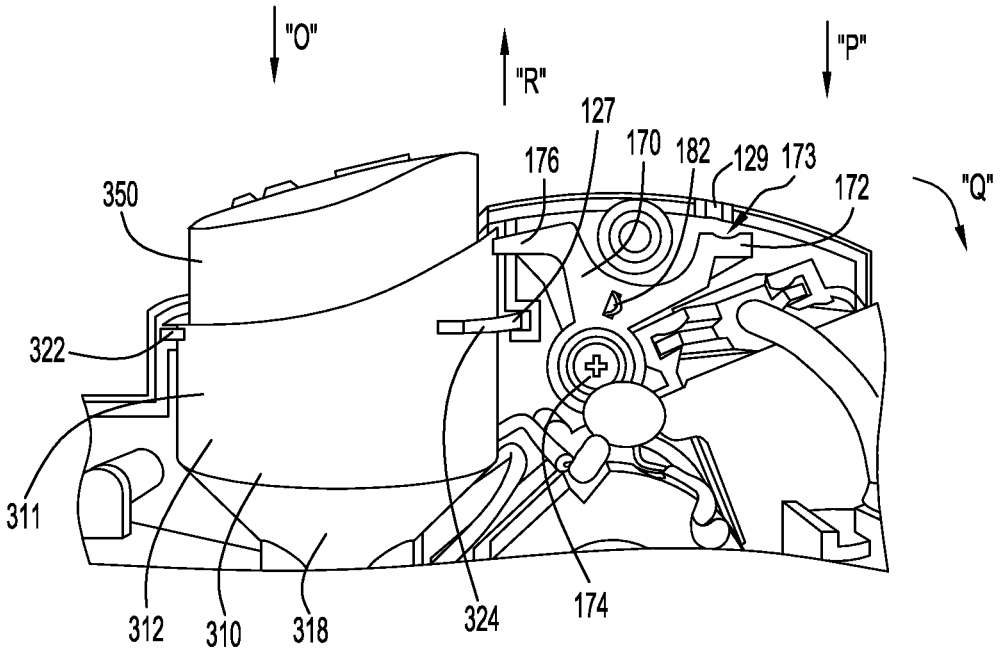
FIG. 18 illustrates a close-up side view of a portion of the blower housing showing the particle supply components of the blower illustrated in FIG. 10.

Referring to FIG. 18, a close-up view of some of the components of the housing 110 is illustrated. The housing 110 includes a release member 170 that is pivotally mounted to the housing 110. The release member 170 has an end 172 with an engagement surface 173 that can be contacted by a user by inserting an object through a slot or opening 129 in the housing 110 to engage the surface 173. The release member 170 is pivotally mounted by a connector 174, which defines an axis of rotation for the release member 170. The release member 170 also includes another end 176 that is in contact with the housing 350 that is mounted in the hopper 310.

When a force is applied to surface 173 of the release member 170 along the direction of arrow "P," the release member 170 pivots along the direction of arrow "Q" and end 176 of the release member 170 in engagement with a notch formed in the housing 350 moves along the direction of arrow "R." As a result, the housing 350 extends a slight distance above the upper surface of the blower housing 110, thereby facilitating the grasping of the housing 350 by the user. The housing 350 contains the glitter particles for the blower 100. Thus, when the housing 350 needs to be refilled or replaced, the user can engage the release member 170 to move the housing 350 to a position that facilitates the grasping of the housing 350. The replacement housing 310 can be inserted along the direction of arrow "O" into the hopper 310.

As shown, the hopper 310 includes a wall 312 that has an outer surface 311 from which projections 322 and 324 extend. The projections 322 and 324 can be slid into grooves formed in the housing portions 112 and 114, such as groove 127, which retains the hopper 310 in its desired position. The hopper 310 also includes a tapered or angled lower end 318.

Figure 19:
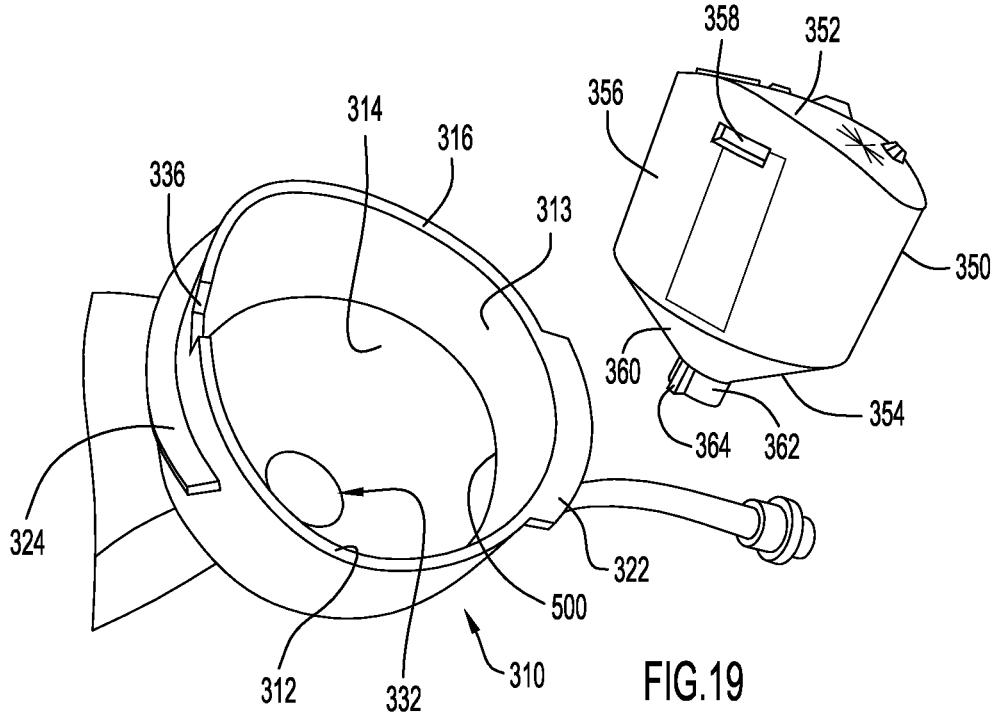
FIG. 19 illustrates an exploded perspective view of some of the particle supply components of the blower illustrated in FIG. 10.

Referring to FIG. 19, the hopper wall 312 has an inner surface 313 that defines a receptacle 314 into which the housing 350 can be inserted. The hopper 310 has an upper end 316 that includes a notch 336 formed therein that allows the engagement end 176 of the release member 170 to engage the housing 350.

Figure 20:
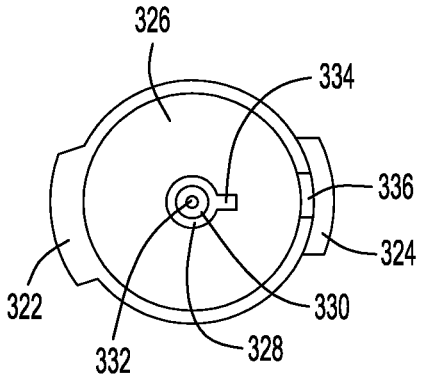
FIG. 20 illustrates a top view of the hopper of the blower illustrated in FIG. 10.

As shown in FIGS. 19 and 20, the lower end 318 of the hopper 310 includes an opening 332 through which glitter particles 500 can exit the hopper 310. The opening 332 is defined by a shoulder 330 that is surrounded by a channel 328 and an inner angled surface 326. An alignment notch 334 is formed along part of the channel 328.

Referring to FIG. 19, the housing 350 has an upper end 352, a lower end 354, and a side wall 356 that extends between them. Formed in the side wall 356 is a notch 358 that can be engaged by an end of the release member 170, as described above. The lower end 354 has an angled surface 360 that has the same configuration or angle as the surface 326 of the hopper 310. An outlet or port 364 is located at the lower end 354 and includes a guide or projection 362 proximate thereto. The projection 362 is aligned with and engages the slot 334 when the housing 350 is inserted into the hopper 310. The housing 350 has an internal chamber in which particles, such as glitter particles, are stored and from which the particles are supplied to the hopper 310 and the tube 440.

Figure 21:
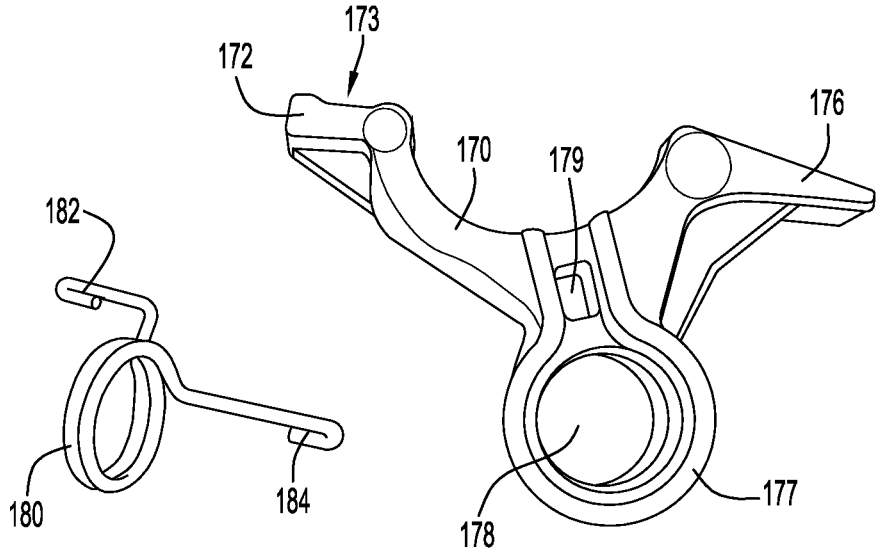
FIG. 21 illustrates an exploded perspective view of some of the components of the blower illustrated in FIG. 10.
Figure 22:
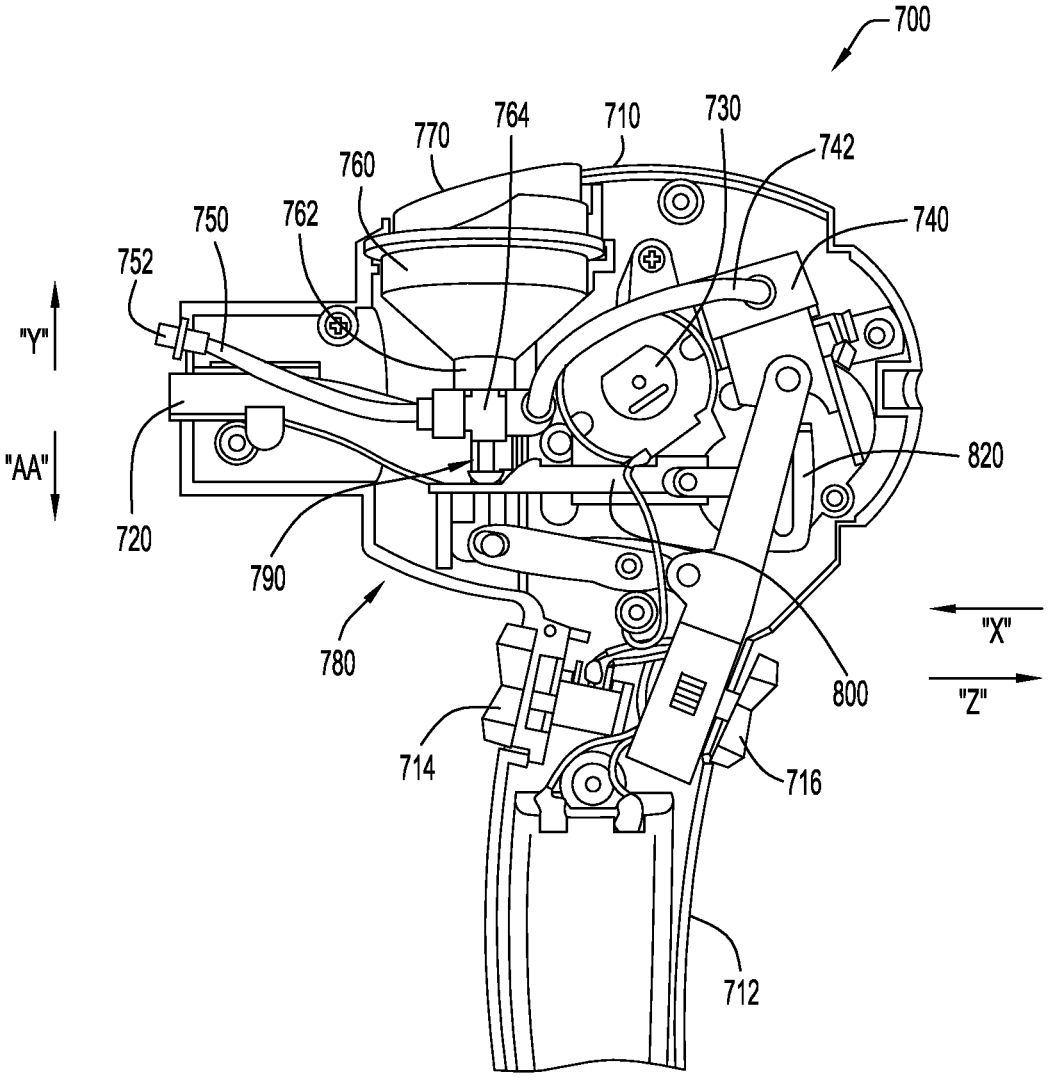
FIG. 22 illustrates a side view of another embodiment of a blower according to the present invention.

Referring to FIG. 21, an embodiment of the release member 170 is illustrated. The release member 170 includes a body with opposite ends 172 and 176. The engagement surface 173 is illustrated in FIG. 21. The body includes a center or mounting portion 177 with an opening 178 that is used to pivotally mount the release member 170 to housing portion 114. The body also includes an opening 179 that receives an end of a biasing member 180. The biasing member 180 has a center portion 181 and two end portions 182 and 184 that are different lengths. The center portion 181 can be positioned into opening 178. End portion 184 is engaged with the housing portion 114 and end portion 182 is engaged with the release member 170 (see also FIG. 18), which biases the release member 170 into engagement with the housing 350.

Referring to FIGS. 22-26, an alternative embodiment of a blower according to the present invention is illustrated. In this embodiment, the blower 700 includes a housing 710 that has a handle 712 that can be gripped by a user. Many of the features and components of blower 700 are similar to blower 100. Located on the handle 712 are an activation switch 714 and a mode switch 716. The blower 700 includes an air output tube 720 and a motor or drive 730 that drives a fan to blow air through the tube 720. The blower 700 also includes a chamber 740 coupled to end 742 for blowing glitter through the tube 750 and out of nozzle 752. In one alternative embodiment, the chamber 740 can be similar to the bellows for blower 100, as described above. In another embodiment, the chamber 740 can be continuously operable and constantly blowing air and glitter particles.

The blower 700 includes a housing 770 that contains particles, such as glitter particles, and that can be inserted into a hopper 760 that is in communication with the tube 750. The hopper 760 has a lower end with a port 762 that is in communication with a chamber 764.

The blower 700 includes a metering mechanism 780 that controls the entry or feeding of glitter particles into the chamber 764 and the tube 750. In this embodiment, the metering or particle control mechanism 780 includes a valve member or pin 790 with a head 792 at one end and a blocking member 796 at an opposite end (see FIG. 25), which functions as a valve-like structure. The pin 790 can be referred to alternatively as a release member or a control mechanism. The pin 790 is movable relative to the chamber 764 between a raised position and a lowered position. When the pin 790 is raised, the blocking member 796 is spaced apart from an opening in the chamber 764, thereby allowing glitter particles to pass through the opening in the chamber 764 and into the tube 750. When the pin 790 is lowered, the blocking member 796 covers the opening in the chamber 764 and prevents glitter particles from passing through the opening in the chamber 764.

Figure 23:
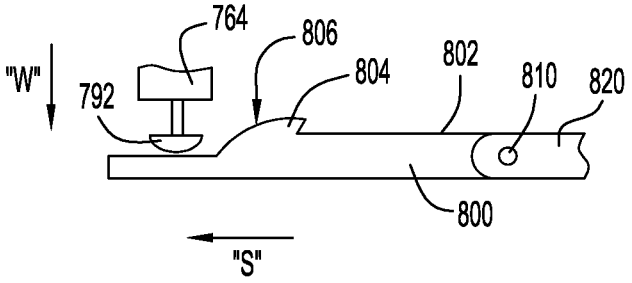
FIG. 23 illustrates a side view of some of the components of the metering mechanism of the blower illustrated in FIG. 22 in a first configuration.

The metering mechanism 780 includes a lever or actuator 800 that is slidably mounted in the housing 710. The actuator 800 can be referred to alternatively as an elongate member or a reciprocating member. As shown in FIG. 23, the lever 800 includes an upper surface 802 with an engagement portion or projection 804 having a contact surface 806. The lever 800 is coupled to a cam 820 via a coupler 810. The cam 820 is reciprocated by the drive 730 such that the cam 820 moves back and forth along the directions of arrows "X" and "Z" in FIG. 22.

Figure 24:
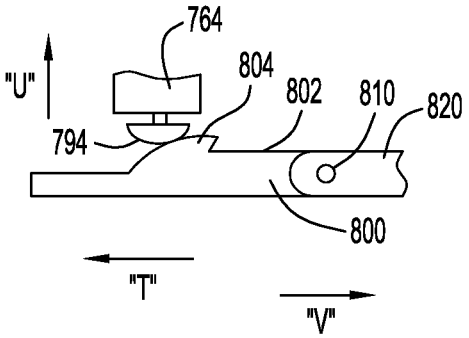
FIG. 24 illustrates a side view of the components illustrated in FIG. 23 in a second configuration.
Figure 25:
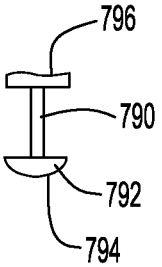
FIG. 25 illustrates a side view of a pin of the metering mechanism illustrated in FIG. 23.

Referring to FIGS. 23 and 24, when the lever 800 moves along the directions of arrows "S" and "T," surface 806 engages surface 794 of head 792 and moves the pin 790 along the direction of arrow "U." When the pin 790 is in its raised position shown in FIG. 24, glitter particles are fed into the tube 750.

When the cam 820 and the lever 800 are moved along the direction of arrow "V" in FIG. 24, the pin 790 moves downwardly along the direction of arrow "W" in FIG. 23 when surface 806 disengages from surface 794. As a result, glitter particles are prevented from exiting the hopper 760 and entering the tube 750. Referring back to FIG. 22, the movements of actuator 800 are illustrated by the arrows "X" and "Z" and the corresponding movements of the pin 790 are illustrated by the arrows "Y" and "AA." The movements of the actuator 800 and the pin 790 are along directions that are substantially perpendicular to each other.

Figure 26:
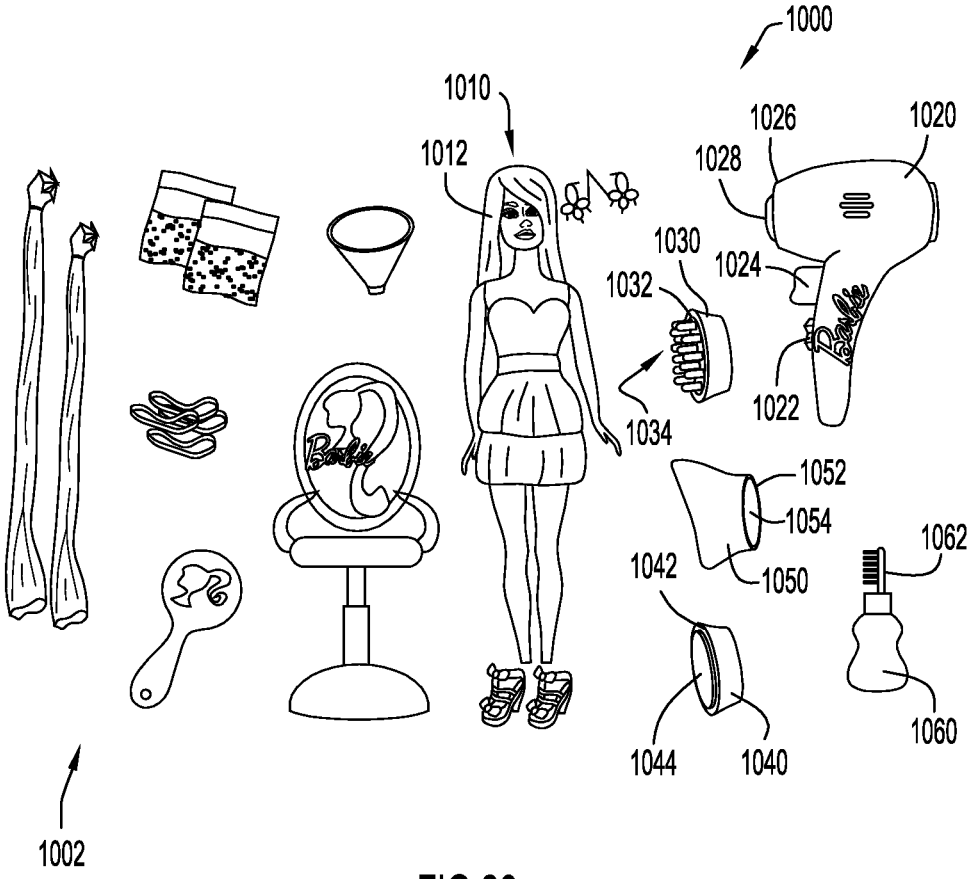
FIG. 26 illustrates a perspective view of various components of another embodiment of a toy assembly according to the invention.

Referring to FIG. 26, an alternative embodiment of a toy assembly according to the present invention is illustrated. In this embodiment, the toy assembly 1000 includes various accessories 1002 and a doll 1010 that has hair 1012 with color changing features or characteristics. The toy assembly 1000 includes a blower 1020 that generates an air flow therefrom. The blower 1020 includes a mode switch 1022 and an activation switch 1024, which can be actuated to change the mode of the blower 1020 and to turn on a drive within the blower 1020, respectively.

The blower 1020 has a front end 1026 to which various components or attachments can be coupled to change the functionality of the blower 1020. In one implementation, the front end 1026 includes a mounting structure 1028 to which the components can be attached.

One component 1030 is a cooling component that can be snapped onto the front end 1026 of the blower 1020. The cooling component 1030 has a body 1032 with several projections 1034 extending therefrom. In one embodiment, the body 1032 is formed of aluminum. The body 1032 of the cooling component 1030 includes an internal chamber or receptacle into which a cool or cold liquid and/or solid can be inserted. For example, cold water and/or ice cubes can be inserted into the cooling component 1030. When the cooling component 1030 is brought into contact with the doll's hair 1012, which has thermochromic properties, the color of the doll's hair 1012 can be changed, such as from its normal color to different color or alternatively, from a different color to its normal color.

Another component 1040 is a heating or warming component that can be snapped onto the front end 1026 of the blower 1020. The heating component 1040 has a body 1042 with an outer surface 1044. In one embodiment, the body 1042 is formed of aluminum. The body 1042 of the heating component 1040 includes an internal chamber or receptacle into which a warm or hot liquid can be inserted. For example, warm water can be inserted into the heating component 1040. When the heating component 1040 is brought into contact with the doll's hair 1012, the purple or pink (or other color) color of the doll's hair 1012 can be changed back to its normal color or alternatively, the normal color of the hair changed to a different color.

Another component 1050 is a particle or glitter component. Glitter component 1050 has an end 1052 with an opening 1054 that enables it to be mounted onto the blower 1020. The glitter component 1050 includes an internal chamber with glitter particles therein. When air is blown by the blower 1020 through the glitter component 1050, glitter particles are dispersed from the blower 1020 in the air flow.

The toy assembly 1000 also includes a bottle 1060 with a comb-like dispensing structure 1062 that can be used to apply gel from the bottle 1060 to the hair 1012 of the doll 1010. By applying the gel to the doll's hair 1012, glitter particles adhere to the doll's hair 1012, thereby enhancing the appearance of the doll 1010.

Referring to FIGS. 27-30, another embodiment of a toy assembly according to the invention is illustrated. In this embodiment, the toy assembly 1100 includes a blower 1110 with a handle 1120 having a mode switch 1124 and an actuation switch 1122 located thereon. The blower 1110 includes a front end to which one of several components can be coupled. In this embodiment, the toy assembly 1100 includes a cooling component 1200 and a heating component 1300. Forming the front end is a nozzle structure 1150 that includes a chamber into which one of the components 1200 and 1300 can be inserted. In this embodiment, the nozzle structure 1150 can function as the glitter attachment because it contains glitter particles that can be dispensed from the blower 1110.

As shown in FIG. 27, the cooling component 1200 includes a body 1210 with an internal receptacle or chamber 1212 with an end 1214. The end 1214 has an opening into which a cold liquid or solid can be inserted and a lid 1215 that can be screwed onto the body 1210 to seal the receptacle or chamber 1212. Coupled to an opposite end of the body 1210 is a plate or engagement portion 1230 that has several projections 1232 (see FIGS. 29 and 30) extending therefrom. The plate 1230 and projections 1232 can be moved into contact with the hair of a doll to change the color of the hair, which is thermochromic. The cooling component 1200 can be inserted into the chamber of the nozzle structure 1150.

As shown in FIG. 28, the heating component 1300 includes a body 1310 with an internal receptacle or chamber 1312 with an end 1314 to which a lid 1315 is removably secured, such as by threads. Coupled to the opposite end of the body 1310 is a plate or engagement portion 1330 that conducts heat from the warm liquid in the chamber 1312 and facilitates the application of the heat to the hair of the doll.

In one embodiment, the blower can be used to blow out the hair of a doll and if a gel or other tacky or adhesive substance is applied to the doll's hair, glitter particles can be applied to the hair. The color change mechanism can be used to change the color of the doll's hair by inserting warm or cold liquids into the chamber of the color change mechanism and using it on the doll's hair. In one embodiment, the doll's hair changes from blond to pink and the highlights in the hair from light pink to dark pink and purple. The color changes can be reversed using the color change mechanism as well. The blower can be used to "glitterize" the doll's hair by adding sparkles (glitter particles) to the hair and to "blow dry" the hair. The gel can be applied to particular portions of the hair for targeted glitterized areas.

In one embodiment, a toy comprises a housing having a first opening and a second opening spaced apart from the first opening, a blowing mechanism disposed in the housing, the blowing mechanism configured to blow air through the first opening in the housing, a container disposed in the housing, the container holding a plurality of glitter particles, the container being in communication with the second opening in the housing, a metering mechanism that is operably coupled to the container, the metering mechanism allowing glitter particles to exit the container when the metering mechanism is actuated, a first switch connected to the blowing mechanism and operable by a user to activate the blowing mechanism, and a second switch connected to the metering mechanism and operable by a user to activate the metering mechanism.

In one embodiment, the metering mechanism includes an elongate member with an engagement portion disposed thereon, and a release member movably mounted relative to the container and engaged with the container, the engagement portion of the elongate member engages the release member as the elongate member moves in the housing and causes the release member to move relative to the container, thereby resulting in the discharge of glitter particles from the container.

In an alternative embodiment, the elongate member and the release member move along lines that are substantially perpendicular to each other.

In an alternative embodiment, the elongate member moves front to back within the housing and the release member moves up and down within the housing.

In an alternative embodiment, the elongate member reciprocates relative to the housing and the release member is periodically activated.

In one embodiment, the metering mechanism is periodically activated during the operation of the blowing mechanism.

In an alternative embodiment, the housing includes a nozzle portion coupled thereto, the nozzle portion defines the first opening and the second opening, and the second opening is disposed proximate to the first opening. Also, the blowing mechanism can be a motor-driven blower.

In another embodiment, a toy assembly includes a housing including a source of air disposed in the housing, the air source configured to blow air through an opening in the housing, and a mounting portion, and a plurality of components that can be coupled to the mounting portion, the plurality of components including: a first component that can be coupled to the mounting portion, the first component being engageable with a portion of a doll to change the color of the portion of the doll, a second component that can be coupled to the mounting portion, the second component being engageable with the portion of the doll to change the color of the portion of the doll, and a third component that can be coupled to the mounting portion, the third component containing particles that can be dispersed from the housing by the air from the air source.

In one embodiment, the first component includes a body defining a chamber in which a cooling liquid or object can be placed and a lid removably coupled to the body to seal the chamber.

In addition, the first component includes a metallic plate coupled thereto, the metallic plate being engageable with the portion of the doll, the metallic plate having a plurality of projections extending therefrom.

Alternatively, the second component includes its own body defining a chamber in which a warming liquid or object can be placed and a lid removably coupled to the body of the second component to seal the chamber of the second component.

In addition, the second component includes a metallic plate coupled thereto, the metallic plate being engageable with the portion of the doll.

In another embodiment, the housing defines a receptacle which is configured to receive a portion of the first component when the first component is coupled to the housing and a portion of the second component when the second component is coupled to the housing.

In one embodiment, the third component includes a plurality of glitter particles that are distributed by the air from the air source.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A toy, comprising:

a housing;

a blowing mechanism disposed in the housing, the blowing mechanism generating a flow of air that is discharged from the housing;

a first component removably coupleable to the housing, the first component including a first chamber holding a plurality of glitter particles that can be dispersed from the housing by the air from the blowing mechanism when the air passes through the first chamber; and a second component removably coupleable to the housing, the second component being engagable with a portion of a doll to change a color of the portion of the doll, wherein the second component comprises:

a body defining a second chamber in which a liquid or an object can be placed; and a lid configured to seal the second chamber, wherein the lid seals the second chamber when the lid is coupled to the second component and the second component is coupled to the housing, such that the lid prevents the flow of air from passing through the second chamber and the liquid or the object disposed in the second chamber remains in the second chamber when the second component is coupled to the housing.

2. The toy of claim 1, further comprising:

an actuating switch operable by a user to activate the blowing mechanism; and a mode switch operable by the user to select between a first mode of activation of the blowing mechanism alone and a second, different, mode of activation of the blowing mechanism, the blowing mechanism providing an intermittent flow of air in the first mode and a continuous flow of air in the second mode.

3. The toy of claim 1, further comprising:

a mounting portion, the first component and the second component each being removably coupleable to the housing via the mounting portion.

4. The toy of claim 3, wherein the mounting portion includes a threaded portion, and each of the first component and the second component includes a threaded member that can be used with the threaded portion to couple the first component and the second component to the mounting portion.

5. The toy of claim 1, wherein the lid includes at least one projection configured to transfer the temperature of the liquid or the object in the second chamber to the portion of the doll when the second component engages the portion of the doll to change the color of the portion of the doll.

6. The toy of claim 1, wherein the portion of the doll is hair of the doll.

7. The toy of claim 1, wherein the glitter particles are dispersed through an opening in the first component when the air passes through the first chamber and exit the housing via an opening in the housing.

8. The toy of claim 1, further comprising:

a third component, the third component being removably coupleable to the housing and engagable with the portion of a doll to change a color of the portion of the doll, wherein the third component changes the color of the portion of the doll to a first color and the second component changes the color of the portion of the doll to a second color.

9. The toy of claim 8, wherein the second component is a cooling component.

10. The toy of claim 8, wherein the third component is a heating component.

11. The toy of claim 1, wherein the lid is only removable when the second component is removed from the housing.

12. A toy assembly for use with a doll, comprising:

a housing including:

an open front end;

an air source disposed in the housing and configured to blow air through the open front end; and a mount on the front end configured to removably receive one of a plurality of components, the plurality of components including:

a first component defining a first chamber that is sealable by a lid, wherein the lid is removable from the first component when the first component is removed from the mount such that the first chamber is configured to receive a first liquid or a first object when the lid is removed from the first component, and wherein the lid seals the first chamber when the first component is secured to the mount to prevent the air blown through the open front end from passing through the first chamber, such that the first liquid or first object disposed in the first chamber remains in the first chamber when the first component is secured to the mount; and a second component defining a second chamber that is sealable by the lid, wherein the lid is removable from the second component when the second component is removed from the mount such that the second chamber is configured to receive a second liquid or a second object when the lid is removed from the second component, and wherein the lid seals the second chamber when the second component is secured to the mount to prevent the air blown through the open front end from passing through the second chamber, such that the second liquid or second object disposed in the second chamber remains in the second chamber when the second component is secured to the mount.

13. The toy assembly of claim 12, wherein the first liquid and the first object are hot and the first component is configured to engage a portion of a doll to change a color of the portion of the doll to a first color and the second liquid and the second object are cold and the second component is configured to engage the portion of the doll to change a color of the portion of the doll to a second color.

14. The toy assembly of claim 13, wherein the portion of the doll is hair of the doll.

15. The toy assembly of claim 12, wherein the plurality of components further comprises:

a third component defining a third chamber, the third chamber holding a plurality of glitter particles that are dispersed from the third chamber when the air passes through the third chamber.

16. A toy assembly for use with a doll, comprising:

a housing including a nozzle;

an actuation switch;

a mode switch configured to switch between a first mode and a second mode; and a blower configured to blow air through the nozzle at a first-rate upon actuation of the actuation switch when the mode switch is in the first mode and the blower configured to blow air through the nozzle at a second rate upon actuation of the actuation switch when the mode switch is in the second mode, wherein the nozzle includes a chamber configured to receive:

a first component holding a plurality of glitter particles and the air blown through the nozzle is configured to pass through the component when the component is received in the chamber of the nozzle in order to disperse a portion of the plurality of glitter particles from the component; and a second component including a lid, wherein the lid is sealed to the second component when the second component is received in the chamber such that the lid prevents the air blown through the nozzle from passing through the second component and a liquid or an object disposed in the second component remains in the second component.

17. The toy assembly of claim 16, wherein the first rate is a continuous rate and the second rate is an intermittent rate.

* * * * *